United States Patent [19]

Rathburn

[11] 4,436,334

[45] Mar. 13, 1984

[54] RELEASING OVERSHOT APPARATUS

[75] Inventor: Lloyd C. Rathburn, Friendswood, Tex.

[73] Assignee: Loomis International Inc., Pasadena, Tex.

[21] Appl. No.: 312,770

[22] Filed: Oct. 19, 1981

[51] Int. Cl.[3] ..... E21B 31/12

[52] U.S. Cl. ..... 294/86.3; 294/86.28; 294/86.33

[58] Field of Search ..... 294/86.17–86.19, 294/86.26–86.33, 116

[56] References Cited

U.S. PATENT DOCUMENTS

| | | | |
|---|---|---|---|
| 980,920 | 1/1911 | Burnes | 294/86.3 X |
| 1,801,984 | 4/1931 | Schafer | 294/86.31 |
| 3,863,974 | 2/1975 | Dinning | 294/86.3 |
| 3,950,021 | 4/1976 | Goldschild et al. | 294/86.28 |
| 4,004,835 | 1/1977 | Taylor | 294/86.29 |

*Primary Examiner*—Johnny D. Cherry
*Attorney, Agent, or Firm*—Arnold, White & Durkee

[57] ABSTRACT

In accordance with an illustrative embodiment of the present invention, a releasing and retrieving apparatus for a pack-off tool used in pipe testing operations includes a tubular body having slots in the walls thereof, each slot having an inclined surface at its lower end, elongated gripping members carried in each slot and being movable longitudinally and laterally with respect thereto, a first coil spring urging the gripping members downwardly to cause the lower end portions thereof to be moved inwardly by the inclined surfaces to gripping position, and a second coil spring urging the central regions of the gripping members outwardly so that inward pressure on the respective upper end portions thereof can be employed to pivot the gripping members about the central regions and cause outward movement of the lower end portions to a released position.

11 Claims, 4 Drawing Figures

Fig. 1
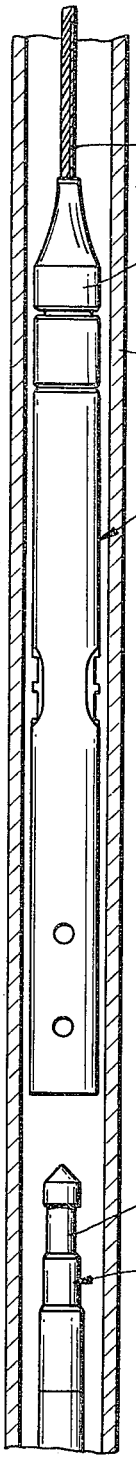
Fig. 2
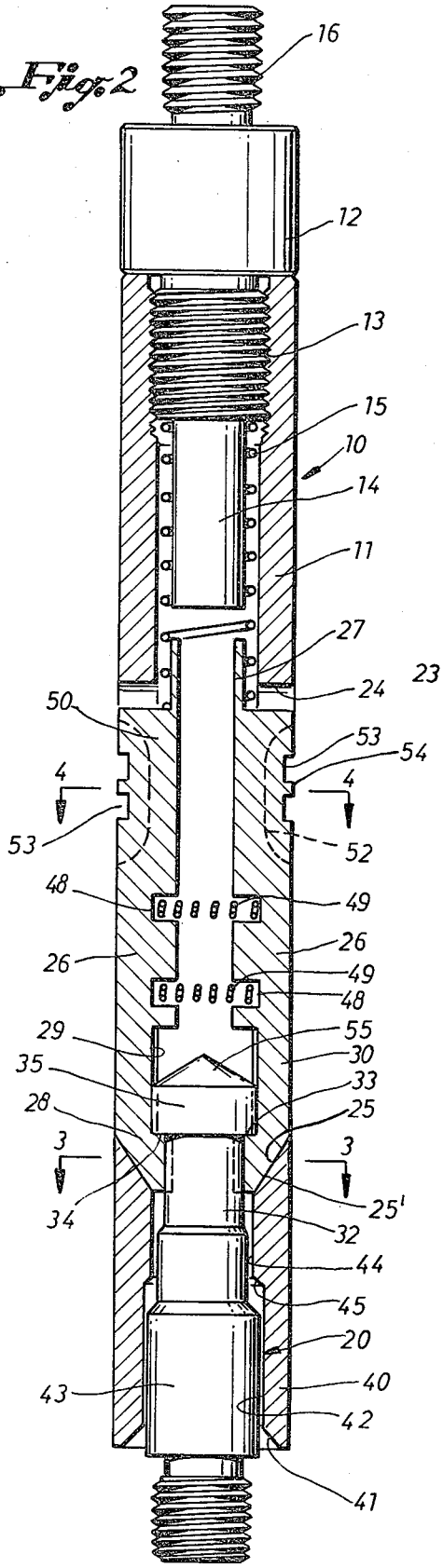
Fig. 4
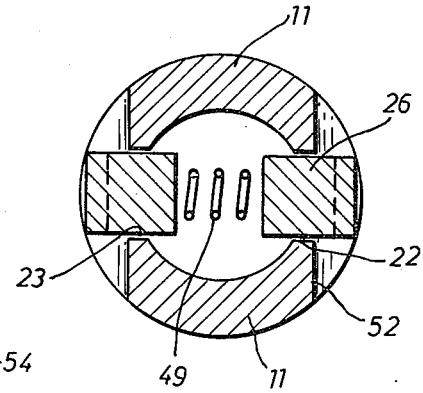
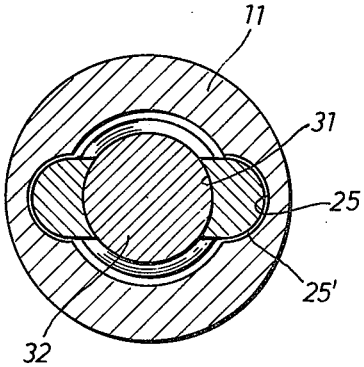
Fig. 3

RELEASING OVERSHOT APPARATUS

FIELD OF THE INVENTION

This invention relates generally to a retrieving device useful in pipe testing operations, and particularly to a new and improved overshot apparatus that can be positioned in a well pipe and automatically engaged with the fishing neck of an associated well tool such as a packer or plug to enable the same to be moved to another sealing location in the pipe.

BACKGROUND OF THE INVENTION

In various well operations such as the pressure testing of pipe that is being lowered into a well, it is necessary to position a pack-off tool in the interior thereof so that fluid under pressure can be used to detect leaks or other defects. In order to remove the tool from the pipe, or to move it to another location therein, it generally is necessary to engage an overshot with a fishing neck on the upper end of the tool and apply upward force to cause release thereof. The various types of overshots which have been used in the past have a number of shortcomings. Many devices employ one or more shear pins or other frangible restraining means that require a jarring action to be applied in the operation of the tool. This type of tool is quite complex in structure and operation and is relatively expensive to manufacture and to maintain. Other devices have gripping members with a scissor-like configuration, and are subject to being broken off in use which renders them inoperable to catch or to hold the fishing neck of the tool that is to be moved in the pipe.

It is the general object of the present invention to provide and new and improved retrieving apparatus of the type described.

Another object of the present invention is to provide a new and improved overshot apparatus that is relatively simple in construction and operation, and which does not employ shear pins or like elements in the operation thereof.

Another object of the present invention is to provide a new and improved retrieving tool that still will remain connected to the fishing neck of an associated well device even though a gripping member has been inadvertently broken in use.

Still another object of the present invention is to a new and improved retrieving tool of the type described that is more simple in construction and reliable in operation than prior devices.

SUMMARY OF THE INVENTION

These and other objects are attained in accordance with the concepts of the present invention through the provision of a retrieving tool comprising a tubular housing having diametrically opposed slots in the wall thereof, with each slot having an inclined surface at the lower end thereof. An elongated gripping member is carried in each slot and is movable longitudinally and laterally with respect to the housing. A first spring means urges the lower end portion of the gripping members into engagement with the inclined surfaces to cause such lower portion to move inwardly to a gripping position, and a second spring means reacts between central regions of the gripping members and enables inward pressure on the upper end portion thereof to be employed to pivot the members about such central regions and cause outward movement of said lower end portions to a released position. The retrieving tool that is the subject of the present invention does not require or include shear pins, and the gripping members are sized and arranged with respect to the fishing neck of the tool to be pulled such that one member will remain engaged therewith even though the other member has become inoperable through breakage or the like.

BRIEF DESCRIPTION OF THE DRAWINGS

The present invention has other objects, features and advantages that will become more clearly apparent in connection with the following detailed description of a preferred embodiment, taken in conjunction with the appended drawings in which:

FIG. 1 is a somewhat schematic view of a retrieving tool being inserted into a section of pipe in order to engage a well device;

FIG. 2 is a cross-sectional view of the retrieving tool of FIG. 1;

FIG. 3 is a cross-sectional view taken on lines 3—3 of FIG. 2; and

FIG. 4 is a cross-section taken on lines 4—4 of FIG. 2.

DESCRIPTION OF A PREFERRED EMBODIMENT

Referring initially to FIG. 1, an overshot or retrieving apparatus 10 that is constructed in accordance with the present invention is shown suspended in a pipe 19 such as a length of tubing that is being hydraulically tested for leaks as sections thereof are threaded end-to-end and lowered into a well. A fishing neck 20 connected to the upper end of a hydraulic tester tool (not shown) is arranged to be automatically engaged by the overshot 10 to enable the tester tool to be shifted upwardly to new locations in the tubing as testing operations proceed. After the tool has been repositioned, the overshot 10 will be exposed at the upper end of the pipe as will be apparent to those skilled in the art, and can be manually released from the fishing neck 20 in a manner to be described herein.

As shown in detail in FIG. 2, the overshot apparatus 10 includes a generally tubular housing 11 having a hollow interior that is closed at its upper end by a head 12 that is threaded thereto at 13. A stem 14 depends from the head 12 and serves as a guide for the upper end of a coil spring 15 that functions in a manner to be described below. The upper end of the head 12 is reduced in diameter and is connected by a screw-threaded pin 16 to a typical socket member 17 (FIG. 1) by means of which the overshot 10 is connected to a flexible line 18 upon which the apparatus is lowered into and removed from the pipe 19.

A pair of longitudinally extending slots 22 and 23 (FIG. 4) are formed in the opposite side walls of the housing 11. The upper end surface 24 of each slot provides a stop shoulder, whereas the lower end surface 25 of each slot is inclined downwardly and inwardly toward the centerline of the housing 11. A pair of elongated gripping members or dogs 26 are disposed diametrically opposite each other within the slots 22 and 23, and each dog has an arcuate tang 27 at its upper end that extends upwardly into the lower end portion of the coil spring 15. The spring 15 is under a degree of compression so as to continuously urge each of the dogs 26 downwardly with respect to the housing 11.

The lower end section 30 of each dog 26 is provided with an internal recess 29 located above a catch portion 28 that extends inwardly as shown. The inner surface 31 of each catch portion 28 is curved to fit closely against the shaft 32 of the fishing neck 20, and an upwardly facing shoulder 33 is provided to engage underneath a companion undercut shoulder 34 on the head 35 of the neck 20 when the tool is coupled thereto.

The lower section 40 of the barrel 11 has an internal chamfer 41 leading to an internal wall surface 42 that is sized to fit over the lower section 43 of the fishing neck 20. A reduced diameter wall surface 44 provides a downwardly facing shoulder 45 that limits downward movement of the housing 11 with respect to the fishing neck 20.

Pairs of diametrically opposed recesses 48 are formed in the inner walls of each gripping member 26 and receive the ends of coil springs 49 that urge the central regions of the members laterally outward. The springs 49 enable inward pressure on the upper end portions 50 of each gripping member 26 to be used to cause pivotal rotation of the lower end portions 30 to an outer released position with respect to head 35 of the fishing neck 20.

Longitudinally extending flats 52 (FIG. 4) are formed in the outer wall of the housing 11 near the upper ends of the slots 22 and 23. That portion of each gripping member 26 that is exposed at each flat is externally recessed at 53 to provide an outwardly directed ridge 54. The flats 52 facilitate manual application of inward pressure to the upper sections 50 of the gripping members to cause release of the tool from the fishing neck as described above, and the ridges 54 enable the members to be grasped and shifted upwardly during the releasing operation.

OPERATION

The overshot apparatus 10 assembled as shown in the drawings is lowered into the well pipe 19 being tested for leaks or other flaws when it is desired to move the tester tool upwardly in the pipe to another sealing location. Initially the gripping members 26 occupy their lower positions with respect to the housing 11, and are urged toward such positions by the coil spring 15. The inclined surfaces 25 at the lower end of the slots 22 and 23 engage the companion surfaces 25' on the lower end of each gripping member and tend to shift the catch portions 28 laterally inward, however the springs 49 hold the members approximately in the positions shown in FIG. 2.

When the lower end of the housing 11 reaches the fishing neck 20, continued downward movement causes the head 35 to enter the bore 44 of the housing section 40 until the cone-shaped upper end surface 55 engages the lower end surfaces of the catch portions 28. As the weight of the overshot is slacked off on the fishing neck, the gripping members 26 shift jointly upwardly within the slots 22 and 23 to a position enabling outward tilting thereof by an amount sufficient to enable the head 35 to enter into the recessed area 29 of the members. When this occurs the power spring 15 functions to shift the gripping members 26 downwardly relative to the slots, and the companion inclined surfaces 25 and 25' function to wedge the catch portions 28 inwardly underneath the undercut shoulder 34. In this position the fishing neck 20 is latched into the overshot 10, and an upward pull on the line 18 will cause the fishing neck and the tester tool attached thereto to be moved upwardly within the tubing 19.

It should be noted that the fishing neck 20 fits rather snugly into the bores 42 and 44 at the lower end of the housing 11 and cannot move laterally to any appreciable extent therein. Thus the overshot can engage and latch onto the fishing neck so long as one of the gripping members 26 remains operable. In other words, should the lower section 28 of one of the gripping members 26 be accidentally broken off, or even though intact be jammed in some manner in an inoperable position, the other gripping member still can catch the fishing neck so that the test tool assembly can be raised upwardly in the tubing 19.

To release the gripping members 26 from the fishing neck 20 when it is desired to do so, the members are grasped manually at the region of the flats 52 in barrel 11 and moved upwardly somewhat against the bias of the spring 15 to separate the inclined surface 25' on the lower end of each catch portion 28 from the inclined surfaces 25 at the lower end of the slots 22 and 23. Then the upper end portions 50 of the gripping members 26 are pressed inwardly toward one another to cause pivotal rotation about the transverse springs 49, and consequent outward movement of the lower end section 30 of each member. Such outward movement enables the catch shoulders 34 to clear the head 35 of the fishing neck 20 so that the lower end portion of the housing 11 can be moved upwardly and away therefrom.

It now will be recognized that a new and improved retrieving tool has been disclosed. The tool is very simple and reliable in construction and operation, and does not employ any shear pins or the like that have been required in similar devices in the past. The tool will engage and suspend an associated device even though only one of the gripping members is operable, and is relatively simple in construction and operation. Since various changes or modifications may be made by those skilled in the art without departing from the inventive concepts involved, it is the aim of the appended claims to cover all such changes and modifications falling within the true spirit and scope of the present invention.

What is claimed is:

1. A retrieving apparatus comprising: a tubular body having a slot in the wall thereof and an inclined surface at the lower end of said slot; an elongated gripping member carried in said slot and being movable longitudinally and laterally with respect thereto; first resilient means for urging the lower end portion of said gripping member into engagement with said inclined surface to cause said lower end portion to move inwardly to a gripping position; and second resilient means for urging a central region of said gripping member laterally outward whereby inward pressure on the upper end portion thereof can be employed to pivot said gripping member about said central region and cause outward movement of said lower end portion to a released position.

2. The apparatus of claim 1 wherein said gripping member has an inwardly directed shoulder at the lower end thereof and an interior recess above said shoulder, said recess being adapted to receive the head of an associated fishing neck with the upper surface of said shoulder engaging a downwardly facing surface of said head.

3. The apparatus of claim 2 wherein the lower end section of said body has an internal bore arranged to receive said fishing neck, said fishing neck and bore having transverse dimensions sized to prevent any substantial lateral play of said fishing neck within said bore.

4. The apparatus of claim 3 wherein said body and fishing neck have coengageable shoulder surfaces for limiting penetration of said fishing neck into said bore.

5. The apparatus of claim 1 wherein said first resilient means comprises a coil spring received in the upper section of said body and reacting between a downwardly facing shoulder on said body and an upwardly facing shoulder on said gripping member.

6. The apparatus of claim 5 further including means on the upper end of said gripping member for limiting lateral outward movement thereof with respect to said slot, said limiting means extending upwardly into the lower end of said coil spring.

7. The apparatus of claim 1 wherein said second resilient means comprises at least one coil spring reacting against an inwardly facing shoulder on said gripping member.

8. A retrieving apparatus comprising: a tubular body having oppositely disposed longitudinally extending slots in the wall thereof, each of said slots having an inclined surface at its lower end; an elongated gripping member carried in each of said slots and being movable longitudinally and laterally with respect thereto; first resilient means reacting between said body and said gripping members for urging the lower end portions thereof into engagement with said inclined surfaces to cause said lower end portions to move inwardly to a gripping position; second resilient means reacting between central portions of said gripping members and urging said central portions laterally outward whereby inward pressure on the upper end portions thereof can be employed to pivot said gripping members about said central portions to cause outward movement of said lower end portions to a released position; and means projecting from the upper end of each gripping member for limiting outward movement with respect to said body, said first resilient means being constituted by a coil spring having its lower end section received over said limiting means.

9. The apparatus of claim 8 wherein said second resilient means comprises at least one coil spring extending transversely between said gripping members and having its respective ends received in oppositely disposed recesses in said gripping members.

10. The apparatus of claim 8 wherein the lower end section of said body has an internal bore arranged to receive the fishing neck of an associated well tool, said fishing neck and bore having transverse dimensions sized to prevent substantial lateral play of said fishing neck within said bore.

11. The apparatus of claim 10 wherein said body and fishing neck have coengageable shoulder surfaces for limiting penetration of said fishing neck with said bore.

* * * * *